United States Patent [19]

Boorujy et al.

[11] 3,985,502

[45] Oct. 12, 1976

[54] METHOD OF CLEANING FABRICS

[76] Inventors: Edward J. Boorujy, 880 Mountain Ave., Berkeley Heights, N.J. 07922; Thomas P. Boorujy, 114 Grant Ave., New Providence, N.J. 07974; Frank Higgins, 1462 Longhill Road, Millington, N.J. 07964

[22] Filed: May 19, 1975

[21] Appl. No.: 578,932

[52] U.S. Cl. ..... 8/137; 252/170; 252/171

[51] Int. Cl.[2] ..... B08B 3/00

[58] Field of Search ..... 8/137; 252/170, 171

[56] References Cited

UNITED STATES PATENTS 3,574,524 4/1971 Hirshfeld ..... 8/137

3,862,049 1/1975 McGrath et al. ..... 252/DIG. 15

OTHER PUBLICATIONS

Dow Technical Info., "Home Laundering Garments Containing Dacron", Mar. 1967, p. 5.

Dow Technical Info., "Handling Articles Containing Dacron in the Laundry Industry", Mar. 1973, p. 3.

*Primary Examiner*—Donald Levy
*Assistant Examiner*—Maria S. Tungol
*Attorney, Agent, or Firm*—Sherman & Shalloway

[57] ABSTRACT

A method of cleaning and reconditioning textile material with an anionic wetting composition and a nonionic liquid detergent, especially highly soiled garments and filters, and the composition therefor.

8 Claims, No Drawings

METHOD OF CLEANING FABRICS

BACKGROUND OF THE INVENTION a. Field of the Invention

This invention relates to a novel method and composition for reconditioning and cleaning textile materials. More specifically, this invention is directed to a method and composition for cleaning highly soiled textile fabrics, both woven and non-woven, with a composition containing a synthetic organic nonionic detergent and an anionic surface active material.

b. Description of the Prior Art

The cleaning of textiles with detergents is well known including providing conditioners to the textiles so as to improve their solid release and reconditioning properties. However, these prior art methods have failed to provide for suitable cleaning of textiles which are utilized in areas of high contamination. That is, in textiles such as filters utilized in the area of pollution control equipment, garments which are utilized in industry such as provided by uniform rental companies and utilized by mechanics, dust collectors, mops and the like, which are subjected to high contamination and dirt, little improvements have been developed.

In the area of filters which are used with pollution control equipment and are subjected to high temperatures, abrasive action and chemical agents, it has been difficult to launder and recondition the filters sufficiently so as to permit their reuse. The removal of carbon black, cement and extremely fine particles have especially been a problem since it affects the permeability of the filters and clings to the porous areas. Highly soiled garments used by those working with grease and oils have also been found to be difficult to clean because of the mixtures of dirt and its impregnation of the fibers.

SUMMARY OF THE INVENTION

The present invention relates to an improved process and composition for cleaning and reconditioning textile materials such as yarns, cords, fabrics, felts and/or other textile structures or fabrics. More particularly, the present invention relates to a means for cleaning textile materials, both woven and non-woven, which are subjected to areas of high contamination such as work clothes and filters.

It is an object of the present invention to provide a composition and method for cleaning textile structures either prior to subsequent operations such as twisting, weaving, knitting or other textile fabricating procedures, or it may be a subsequent operation such as the cleaning of an already-formed garment or filter element.

A more specific object is to provide a composition and method of cleaning garments and filters after use.

It is a still further object of the present invention to provide a cleaning process which permits reuse of filters that are utilized in environmental control apparatuses.

A yet still further object of the present invention is to clean filters and garments which are soiled with ultrafine particles such as carbon black, dust and the like.

It is also an object of the present invention to clean and recondition textile materials so as to provide the end product with increased suppleness.

In accordance with the present invention, the textile material is treated in an aqueous composition containing an anionic wetting agent and an organic nonionic detergent mixture. For the purposes of general application, the fabric material is first washed to remove surface soil by either undergoing an ordinary wash cycle or flushing with water at a temperature of about 150°–200°F. To remove the soil impregnated in the material, an aqueous composition is prepared containing (1) a nonionic detergent mixture and (2) an anionic wetting agent at a temperature between 150°–200°F. for about 10–30 minutes and then suddenly reducing the temperature at least 40°–60° preferably 50°–60°, that is, in about 5–30 minutes depending on the volume involved. If needed, the fabric material may be further rinsed with water or washed with an additional detergent mixture.

It has been found that the step of suddenly cooling the wash mixture is critical for achieving a release of the contamination or soil from the textile structure. Even when the first wash is repeated several times, it is insufficient to remove the deeply penetrated dirt.

After the second treatment step wherein there is a sudden decrease in temperature, the textile material may be further washed in a conventional manner and dried depending on the type of textile structure and the degree of soilage.

A suitable concentration for general application has been found utilizing 0.1%–10% by weight of a commerically available anionic wetting composition, 1–20% by weight of a commercially available nonionic liquid detergent mixture and 0.5–10% by weight of an organic solvent, preferably a petroleum solvent. Formulations of the anionic surface active mixture include those wherein the surface active agent is combined with vegetable, animal or mineral oils, and in addition, include an amount of a lower alkyl alcohol such as methanol, ethanol, propanol, isopropanol, and the like.

When a commercial process is taken into account, a uniform composition can be obtained by mixing the anionic surface active material with water, adding the organic solvent, preferably a petroleum solvent, and then adding the detergent mixture to the composition.

The amount of the composition used can be widely varied and is also dependent on such factors as the nature, weight and construction of the fabric, at the degree of contamination or dirt. Additionally, the washing conditions may be widely varied and also depend on the type of dirt and construction of the washing apparatus.

Among the suitable nonionic detergent mixture may include one which contains as one component thereof from about 5% to about 9% by weight of an alkyl phenol-ethylene oxide condensate having an alkyl group containing from nine to twelve carbon atoms and containing nine to fifteen oxyethylene units. Typical examples thereof include dodecyl phenol condensed with an average of ten moles of ethylene oxide sold commercially as "Sterox DJ," nonyl phenol condensed with an average of nine moles of ethylene oxide sold commercially as "Igepal CO-630," nonyl phenol condensed with an average of ten moles of ethylene oxide sold commercially as "Tergiitol NPX," and dodecyl phenol condensed with an average of fifteen moles of ethylene oxide. The remaining component of this mixture is from about 1% to about 3% by weight of a polyoxyalkylene alkanol having the empirical formual $HO—(C_2H_4O)_a(C_3H_6O)_b(C_2H_4O)_cH$ where $b$ is an integer from 26 to 30 and a plus $c$ is an integer such that the molecule contains from 0% to 20% of ethylene oxide. Typical examples thereof include "Pluronic L-61" where *b* is an integer from 26 to 30 and a plus *c* is an integer such that the molecule contains from 10% to 20% of ethylene oxide and "Pluronic L-60" where *b* is an integer from 26 to 30 and a plus *c* is zero so that the molecule contains 0% or no ethylene oxide. This mixture will impart detergent and low sudsing properties to the liquid product.

Another suitable synthetic organic nonionic nonsoap detergent mixture is as follows. This mixture contains from about 5% to about 7.5% by weight of a tridecyloxypolyethoxyethanol having the formula $$C_{13}H_{27}O(CH_2CH_2O)_9CH_2CH_2OH$$

This component is prepared by condensing tridecyl alcohol with an average of ten moles of ethylene oxide and is sold commercially as "Sterox AJ-100." The remaining component of this mixture is from about 1% to about 3% by weight of either the above mentioned dodecylphenoxypolyethoxyethanol having a formula

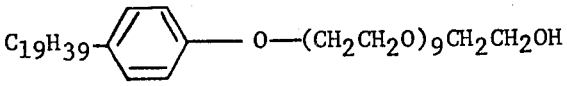

sold as "Sterox DJ" or the above mentioned polyoxyalkylene alkanol having the empirical formula $$HO-(C_2H_4O)_a(C_3H_6O)_b(C_2H_4O)_cH$$

where *b* is an integer from 26 to 30 and a plus c is an integer such that the molecule contains from 0% to 20% of ethylene oxide as exemplified by the above "Pluronic L-60" and "Pluronic L-61."

A further suitable nonionic synthetic organic detergent utilized in the present invention comprises the low molecular weight nonionic condensation products of a fatty alcohol with ethylene oxide or ethylene glycol optionally containing a small proportion of propylene glycol. Normally, this condensation will be with ethylene oxide which is cheaper and does not require the removal of by-product water. Methods for the manufacture of such compounds are well-known and these materials have been previously employed in detergent compositions, although generally their use has been limited to being part of the entire active organic detergent portion of light duty liquid detergents. The low molecular weight nonionics which provide the composition of the present invention are of the formula $RO(C_2H_4O)_nH$ wherein R is an alkyl group preferably having a straight chain of from 10 to 15 carbon atoms and *n* is from 6 to 11 with the proviso that *n* is from 2/5 to 8/11 of the average number of carbon atoms in R. Generally, due to the methods of manufacture, mixed alkyls are employed. Furthermore, the ethylene oxide which reacts with these mixed alkyls will also vary somewhat within the above noted range of from 6 to 11. The ethylene oxide content can vary within this range as long as the amount of ethylene oxide in the final product is within the parameter of from 2/5 to 8/11 of the average number of carbon atoms in the alkyl group. A preferred embodiment of the present invention to utilize a nonionic detergent of the above formula wherein R is a mixed straight chain alkyl having from 10 to 15 carbon atoms, the average number of carbon atoms averaging approximately 12, and *n* is from 6 to 9 with the proviso that *n* is from 2/5 to 3/5 of the average number of carbon atoms in R. Preferred nonionics of said group include Neodol 25-7 (R equals mixed 12–15 carbon atom alkyl, n equals 11 average value) made by Shell Chemical Company and Plurofac B-26, the reaction product of a linear alcohol with a mixture of ethylene and propylene oxides, made by Wyandotte Chemical Company.

The nonionic detergent portion of the heavy duty liquid detergent of the present invention may also contain up to 50% of a high molecular weight nonionic detergent of the formula RO(C H O) H wherein R is a straight chain alkyl of from 14 to 20 carbon atoms and n is from 10 to 14 with the proviso that n is from 7/10 to 1 times the average number of carbon atoms in R. As with the lower molecular weight nonionics, these higher molecular weight nonionics are also produced by reacting mixed alkyls with ethylene oxide chains which include different chain lengths within the 10 to 14 ethylene oxide radical range. Within this range, as noted above, there is a desirable hydrophilic-lipophilic balance which provides compatibility with other composition ingredients. Generally, the alkyl group will be from 14 to 16 carbon atoms and usually the average carbon content of preferred compounds are from 14 to 15 and in the most preferred higher molecular weight nonionic detergent compositions for use with the lower molecular weight nonionics, the alkyl groups will be over 80% 14 to 15 carbon atom chain lengths. Similarly, it is preferable to have from 10 to 12 ethylene oxide radicals per chain and in a most preferred embodiment these will average about, and very preferably be equal to, 11 ethylene oxide units per chain. A preferred higher molecular weight nonionic to be utilized in the composition of the present invention is Neodol 45–11 (R equals mixed 14 to 15 carbon atom alkyls, n equals 11 average value) made by Shell Chemical Company.

Exemplary anionic materials are the water-soluble, straight and branched chain alkylaryl sulfonates, particularly the alkyl benzene sulfonates, wherein the alkyl group contains from about 8 to 15 carbon atoms, the lower aryl or hydrotropic sulfonates such as sodium xylene sulfonate; the olefin sulfonates, such as those produced by sulfonating a $C_{10}$ to $C_{20}$ straight-chained -olefin; hydroxy $C_{10}$ to $C_{24}$ alkyl sulfonates; water-soluble alkyl disulfonates containing from about 10 to 24 carbon atoms; the normal and secondary higher alkyl detergents; particularly those having about 8 to 15 carbon atoms in the alkyl residue such as lauryl or coconut fatty alcohol sulfate; sulfuric acid esters of polyhydric alcohols partially esterified with higher fatty acids such as coconut oil, monoglyceride, monosulfate, coconut, ethanolamide sulfate, lauric acid amide or taurine and the like; the various soaps or salts of fatty acids containing from about 8 to 22, particularly 10 to 18, carbon atoms, such as the sodium, potassium, ammonium and lower alkanol-amine, particularly mono-, di-and tri-ethanolamine salts of fatty acids such as stearic acid, oleic acid, coconut fatty acid, fatty acids derived from palm oil, soybean oil, tallow and the like. Particularly preferred anionic surfactants include the fatty alcohol and ether alcohol sulfates and the sodium salts of fatty acids containing from about 10 to 18 carbon atoms.

The composition of the present invention also includes an anionic detergent which is a sulfated ethoxylated higher fatty alcohol of the formula $RO(C_2H_4O)_n$-$SO_3M$ wherein R is a fatty alkyl of from 10 to 20 carbon atoms, $n$ is from 2 to 6, being from 1/5 to ⅓ of the number of carbon atoms in R and M is a solubilizing salt-forming cation such as an alkali metal, ammonium, lower alkylamino or lower alkanolamino. The fatty alkyl may be terminally joined to the polyxyethylene chain, which, of course, is terminally joined to the sulfur-forming sulfate group.

The ethylene oxide content of the anionic detergent is such that $n$ is from 2 to 6 and is preferably from 2 to 4, generally averaging from 3, especially when R is a mixed 12 to 15 carbon atom alkyl. To maintain a desired hydrophilic-lipophilic balance, when the carbon content of the alkyl chain is in the lower portion of the 10 to 20 range, the ethylene oxide content might be reduced so that $n$ is about 2, whereas when R is of 16 to 18 carbon atoms, $n$ may be from 4 to 6. The salt-forming cation may be any suitable solubilizing metal or radical but will most frequently be alkali metal or ammonium. If alkylamine or lower alkanolamine groups are present, alkyls and alkanols thereof will usually contain one to four carbon atoms and the amines and alkanolamines may be mono-, di- or tri-substituted, e.g., monoethanolamine, diisopropanbolamine, tri-methylamine.

One suitable anionic composition is available from Shell Chemical Company and is identified by them as Neodol 25-3S, the sodium salt, normally sold as a 60% active material, including about 40% of aqueous solvent medium, of which a minor proportion is ethanol. Although Neodol 25-3S is the sodium salt, the potassium salt and other suitable soluble salts may also be used either in partial or complete substitution for that of sodium.

Examples of the higher alcohol polyethenoxy sulfates which may be used as the anionic constituent of the present composition include: mixed $C_{12-15}$ normal primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetra-ethenoxy sulfate, sodium salt; stearyl pentaethenoxy sulfate, trimethylamine salt and mixed $C_{10-18}$ normal alkyl triethenoxy sulfate, potassium salt. Minor proportions of the corresponding branched chain and medially alkoxylated compound such as those described above but modified to have ethoxylation at a medial carbon atom, e.g., one located four carbons from the end of the chain, may be employed but the carbon atom content of the higher alkyl will be the same. Similarly, the joinder of a normal alkyl may be at a secondary carbon one or two carbon atoms removed from the end of the chain.

Descriptions of additional anionic compounds which may be used are found in the text, *Synthetic Detergents*, by Schwartz, Perry and Berch, published in 1958 by Interscience Publishers, New York, see pages 25 to 143; and in U.S. Pat. No. 3,372,188, U.S. Pat. No. 3,260,741, and U.S. Pat. No. 2,507,088. The particular anionic salt will be suitably selected depending upon the particular formulation and the proportions therein.

Substantially any textile material may be subjected to the process of this invention. These include yarn, filaments, staple fibers, woven, knitted and non-woven fabrics, unbonded batts, paper and the like. Any natural or synthetic fibers may be used in these materials including, for example, glass, wool, cotton, asbestos, rayon (regenerated cellulose), cellulose esters such as cellulose acetate, cellulose triacetate and cellulose acetatebutyrate, polyamides of the type having repeating amide units in a polymer chain, for example nylon 66 (polyhexamethylene adipamide), nylon 6 (polycaproamide) and nylon 11 (polyundescanoamide), polyesters of the type having repeating ester links in a polymer chain, for example polyethylene terephthalate and polyethylene terephthalate-isophthalate, acrylic fibers, e.g., polyacrylonitrile, modacrylics, for example copolymers of acrylonitrile with vinyl chloride, polyolefins, e.g., polyethylene and polypropylene, polyurethanes, and others. The fabric may include a mixture of natural and synthetic filaments. For example, the fibers may be 60 percent cotton, 40 percent polyester or 100 percent cotton, etc.

The textiles may be in their natural condition, or they may previously have received other treatments. For example, the fabrics may previously have been treated with aminoplasts or silicone compositions.

For the purpose of cleaning, twisted yarns for weaving, additional twisting, knitting or the like, is rinsed in water of about 150°F and then washed in a second bath having preferred proportions of the several ingredients as follows:

Anionic surfactant mixture 0.1–1%
Nonionic detergent mixture 2.0–6%
Solvent 0.5–2%
Water-balance to make 100%

Proportions given above define the broad ranges of the several component ingredients of the composition for all general applications. It is understood that the surfactant mixture may be one which is commercially available and may include such ingredients as mineral oil, alkyl amines and lower alkyl alcohols.

When the composition is to be used for washing and reconditioning filters which are for use in environmental control apparatuses, the preferred ranges of the composition of the second washing mixture are as follows:

Surfactant mixture 0.5–2%
Nonionic detergent mixture 4–10%
Solvent 1.0–4%
Water-balance to make 100%

When the composition is to be used for washing garments, the preferred proportions of the several ingredients utilized in the washing mixture are as follows:

Surfactant mixture 0.25–1%
Nonionic detergent mixture 1–6%
Solvent 1–2%
Water-balance to make 100%

It is understood that the washing process of the present invention may either follow a convention washing operation which removes the surface dirt or may be subsequent to said washing operation, or both, depending on the type and degree of soilage and the nature of the textile material.

In the following examples which are illustrative of the invention, the proportions are in parts by weight unless otherwise noted.

EXAMPLE 1

A polyester felt filter was immersed in a bath of water at a temperature of 170°–185°F. for a period of 20 minutes, and then flushed twice with water. Then an aqueous composition was formed as follows:

Wisk (nonionic detergent) 5%
Sodium lauryl sulfate (surfactant) 0.5%
Petroleum solvent 1%

Isopropanol 1%
Mineral oil 1%
A mixture of lower alkyl amines 0.01%
Water-balance to make 100%

The filter was padded for about 10 minutes and rinsed. The filter was rinsed with water at a temperature of 115°–120°F. The rinse water was noted as having a high dirt content. The filter was then centrifuged so as to dry and placed in a commercial dryer at a temperature of 150°–170°F. for twenty minutes.

Table 1

| | Permeability (CFM) |
|---|---|
| Original Filter | 0.0 |
| After treatment, before washing | 24.3 |

The permeability was based on the ability of air to pass through the fabric expressed in cubic feet of air per minute per square foot of fabric with a 0.5 inch water pressure differential.

The reconditioned filter was suitable for use in an environmental control apparatus.

EXAMPLE 2

A plain weave broadcloth having a weight of four ounces per square yard made from spun yarn of 65% dacron polyester fibers and 35% cotton was pre-soiled in different areas with corn oil, mayonnaise, butter, lipstick, chocolate, coffee and hair oil, and rubbed thoroughly with the fingers. Then the fabric was washed in a top-load-agitator-type washing machine with water only to remove surface dirt. The washer was set on the wash-wear cycle with wash water temperature set at 170°F. and the composition of Example 1 was added. The cycle, which takes about 35 to 45 minutes, includes 10 minutes of washing as well as immediately rinsing with water at 100°F and spin-drying. After completion of the wash cycle, the sample was tumble dried in a home electric dryer at 150°–170°F. The sample was then placed on a black surface under a fluorescent light for visual inspection and there was observed no noticeable staining of the fabric.

EXAMPLE 3

A polyester felted filter which was used in a chemical filtering process having carbon black was first used in water at a temperature of 170°F. to remove the loose carbon black.

A treating bath was prepared utilizing 1% of Magic Rinse (a commercial fabric softener composition containing about 28% sodium lauryl sulfate), 2% of kerosene was then added, 5% of orthoseil (a nonionic liquid detergent), and water to bring the balance to 100%. The polyester felted fabric was padded in the treating bath for 20 minutes at a temperature of 170°F. Cold water was added to reduce the temperature of the bath to 120°F. and the treating liquor removed. The fabric was rinsed in water at a temperature of 120°F. and dried in an electric dryer at 150°–170°F. for twenty minutes. The permeability was observed as being 28.65 CFM. The permeability which is acceptable has been found to be 25–35 CFM. Therefore, it was observed that the filter was reconditioned for further use.

It will be recognized that various modifications may be made in the invention described herein. In its broadest aspects, the invention contemplates a laundering of textile materials with the process and composition described above. For example, the treatment according to this invention can be applied with useful effects to textile substrates generally and to non-textile substrates.

What is claimed is:

1. A method of cleaning a textile industrial filter which comprises the steps of (1) removing surface soil from said filters (2) washing said filter with an aqueous composition containing 0.1–10% by weight of an anionic wetting composition, 1–20% by weight of a nonionic liquid detergent mixture, 0.5–10% by weight of an organic solvent, and water, at a temperature of 150°–200°F. and then rapidly reducing the temperature by the rapid addition of water by about 40–60°, so as to remove the dirt impregnated therein.

2. A method of claim 1, wherein the anionic wetting composition is sodium lauryl sulfate.

3. A method of claim 1, wherein the nonionic detergent composition is an alkylphenol-ethylene oxide condensate having an alkyl group containing from 9 to 12 carbon atoms and containing 9 to 15 oxyethylene units.

4. A method of claim 1, wherein the filter material is selected from the group consisting of polyamide and polyester fabrics.

5. A method of claim 1, wherein the said filter is first washed in water at a temperature of 150°–200°F. to remove surface dirt.

6. A method of claim 1, including subsequently rinsing with water at a temperature of 120°F.

7. A method of claim 1, including 0.5–10% by weight of an organic solvent.

8. A method of claim 1, wherein said filter is a polyester felted filter.

* * * * *